United States Patent [19]

Wain

[11] 4,229,935

[45] Oct. 28, 1980

[54] JOINING YARNS

[76] Inventor: John K. Wain, Little Arrow, Torver, Coniston, Cumbria, England

[21] Appl. No.: 20,504

[22] Filed: Mar. 14, 1979

[30] Foreign Application Priority Data

| | | | |
|---|---|---|---|
| Mar. 21, 1978 | [GB] | United Kingdom | 11053/78 |
| Apr. 11, 1978 | [GB] | United Kingdom | 14129/78 |
| Apr. 25, 1978 | [GB] | United Kingdom | 16379/78 |
| Apr. 26, 1978 | [GB] | United Kingdom | 16611/78 |
| May 2, 1978 | [GB] | United Kingdom | 17167/78 |
| Jun. 1, 1978 | [GB] | United Kingdom | 26249/78 |

[51] Int. Cl.[2] ..... D01H 15/00

[52] U.S. Cl. ..... 57/22; 57/261

[58] Field of Search ..... 57/22, 23, 261, 263, 57/350; 242/35.6 R, 35.6 E, 37 A

[56] References Cited

U.S. PATENT DOCUMENTS

| | | | |
|---|---|---|---|
| 3,477,217 | 11/1969 | Bell et al | 57/22 |
| 3,581,486 | 6/1971 | Dibble | 57/22 |
| 3,648,336 | 3/1972 | Bevington | 57/22 UX |
| 3,822,538 | 7/1974 | Cordell | 57/22 |

*Primary Examiner*—Donald Watkins

*Attorney, Agent, or Firm*—Pearson &Pearson

[57] ABSTRACT

Yarn portions, particularly yarn ends, are joined together without using a knotting technique by positioning the yarn portions alongside each other and introducing such portions through an inlet of apparatus having two passages extending separately away from the inlet. Fluid flow is directed alternately along one then the other of the passages so as to move the yarn portions backwards and forwards between two passages so as to cause the yarn portions to be joined or spliced together.

15 Claims, 3 Drawing Figures

JOINING YARNS

This invention relates to a method and apparatus for joining yarns. The term yarns is used herein for the sake of convenience but it is to be understood that the invention may be utilised for the joining of any suitable elongate filamentary or fibrous structures whether constituting single threads, fibres, or filaments or assemblies of such threads, fibres, or filaments made by spinning or any other technique or combination of techniques.

It is necessary to join yarn ends in knitting and weaving operations for example to enable a fresh yarn package to be connected to the end of a used package, and to enable breakages to be repaired. Such joining can be effected by knotting but this may not be satisfactory in all instances in so far as knots may snag or otherwise disturb smooth operation of knitting and weaving equipment. Accordingly, there have been other proposals for effecting joining involving techniques including binding, bonding, heat-welding and air-stream entanglement. These known methods however tend to be complex and inconvenient and/or do not give satisfactory joining for a wide range of different kinds of yarns.

An object of the present invention is to provide a method of joining yarns which is simple and convenient to perform and which can give satisfactory joining for a wide range of different kinds of yarns.

According to one aspect of the invention therefore there is provided a method of joining yarns comprising the steps of positioning portions of the yarns alongside each other, introducing said portions into apparatus having an inlet for said portions and two passages in communication with and extending away from said inlet, and causing fluid to flow alternately along one then the other of said passages in a direction away from said inlet such as to cause said yarn portions to be drawn alternately along one then the other of the passages and thereby cause said portions to be joined or spliced together.

With this method it has been found that a wide range of kinds of yarns can be securely joined in a simple and convenient manner and without producing large knots or nodes. Preferably, and in order to effect opening out and longitudinal alignment of filaments or fibres of the yarn portions such as to facilitate satisfactory joining thereof the method of the invention may incorporate an appropriate preliminary yarn treatment step. This preliminary step may be performed in the said apparatus by a sustained fluid flow along one said passage prior to commencement of the said alternate flow. Such sustained fluid flow is particularly effective for opening out and aligning fine, soft continuous filament yarns. For yarns of a tougher and/or denser nature in order to achieve satisfactory opening out it may be necessary or desirable to utilise a more strenuous technique, for example a technique involving mechanical combing, or using a more powerful or more suitably directed air blast or other fluid flow in equipment separate to said apparatus. For yarns of a softer and/or more bulky nature in order to achieve satisfactory alignment it may be necessary to utilise a fluid having damping properties, for example, moisture-laden air.

In a particularly preferred embodiment of the invention, in order to facilitate twisting of the yarn portions to give a secure splice, fluid flow to which such yarns are exposed in a pre-treatment stage and/or fluid flow along at least one and preferably both of said passages, may be caused to move helically.

With regard to the said apparatus, preferably, and in accordance with a second aspect of the present invention, this comprises a chamber with a yarn inlet thereto through which yarn portions arranged alongside each other can be introduced into the chamber, first and second passages in communication with and extending away from said chamber, a pressure fluid inlet to said chamber through which pressure fluid can be directed into said chamber to flow therefrom into one or the other of said passages, and diversion means operable to effect diversion of said pressure fluid from the chamber alternately to one then the other of said passages.

The apparatus may comprise a simple portable device having a trigger grip or other convenient hand held mechanism for use in the manual control of admission of pressure fluid to the said chamber, a readily accessible opening in a casing of the device, which opening constitutes the said yarn inlet, and a valve mechanism constituting said diversion means. With this arrangement an operator may hold the device and control fluid admission with one hand whilst he presents the yarn portions to the yarn inlet with his other hand.

Alternatively, if desired, the apparatus may comprise a device which is appropriately mounted for example on or alongside yarn processing equipment, and if desired automatic equipment may be utilised to effect one or more of; presentation of the yarn portions to the yarn inlet, control of pressure fluid admission, operation of the diversion means.

Most preferably the arrangement of the yarn inlet, the fluid inlet and the first passage are such that unless diverted or stopped by some external influence, fluid tends to flow from the fluid inlet across the said chamber into and along the first passage whilst producing a suction effect at said yarn inlet. With this arrangement the suction effect can facilitate introduction of the yarn portions into the said chamber and the diversion means may have an "off" position at which said fluid flow into the first passage is not restricted or diverted, and an "on" position at which fluid flow is diverted to the second passage. Such diversion may involve simply closure of the first passage so that fluid admitted to the chamber is compelled to flow instead into the said second passage. During such reversal of fluid flow, the yarn inlet may be blocked, for example, by an appropriate automatic or manual mechanism or simply by the operator placing his finger over same, to ensure that fluid flow is not directed out through the yarn inlet. During fluid flow along the first passage the atmospheric air intake and also drawing of yarn through the yarn inlet may be limited by an appropriate automatic external mechanism or manually by the operator or, if desired, the apparatus may incorporate a piston which slides within the chamber across the yarn inlet as the pressure reduces in the chamber and which returns into a side cylinder (the end of which is open to the atmosphere) until restricted by a stop when the chamber pressure increases due to diversion of the fluid flow. In order to effect rapid alternate diversion of fluid flow a rotary valve may be provided having a valve member which is rotatable rapidly between alternate positions at which the first passage is respectively open and closed. The valve member may be driven by pressure fluid taken from said pressure fluid inlet.

The said first passage may take any suitable form but preferably is a straight tubular (preferably cylindrical)

passage with one end thereof connected to the said chamber and the other end thereof connected to the atmosphere via an openable and closable valve constituting said diversion means.

The said second passage may also take any suitable form but preferably comprises a straight tubular passage which extends at right angles to said first passage. Said second passage may be directly open to the atmosphere and may be aligned with the yarn inlet. Alternatively, the second passage may have an inlet leading to a main body portion or central chamber which is in communication with an outlet open or openable to the atmosphere. Such main body portion or central chamber may be at right angles or parallel or at any other suitable disposition relative to the said first passage. If desired said main body portion or central chamber may incorporate therein a structure such as an axially extending fixed or positionally adjustable rod around which, in use, the yarn portions can twist to facilitate splicing of same. Also, if desired, said body portion or central chamber may have an auxiliary inlet therein which may be open to the atmosphere to admit air to be entrained with the said fluid flow along said second passage.

Where a helical fluid flow is to be utilised, this may be produced by introduction of an appropriate guide or deflection structure in the said pressure fluid inlet. Suitably such structure may comprise a wire coil fitting within a tubular nozzle or pipe at said inlet.

The apparatus and method of the invention may be utilised to join the ends of two or more yarns. Also, if desired, the invention may be applied to the joining of two or more yarns along the length of same. In this case the adjacent yarns may be drawn through the joining apparatus so that successive portions thereof are subjected to the joining operation. For this purpose apparatus of the aforesaid kind according to the second aspect of the invention may be utilised if said chamber also has a yarn outlet and feed devices such as rollers are provided at said yarn inlet and outlet which can draw the yarns through the apparatus whilst maintaining a suitable slack within the apparatus necessary for the performance of the joining procedure. The arrangement may be such that the said second passage defines said yarn outlet.

The invention will now be described further by way of example only and with reference to the accompanying drawings in which.

Figure 1:
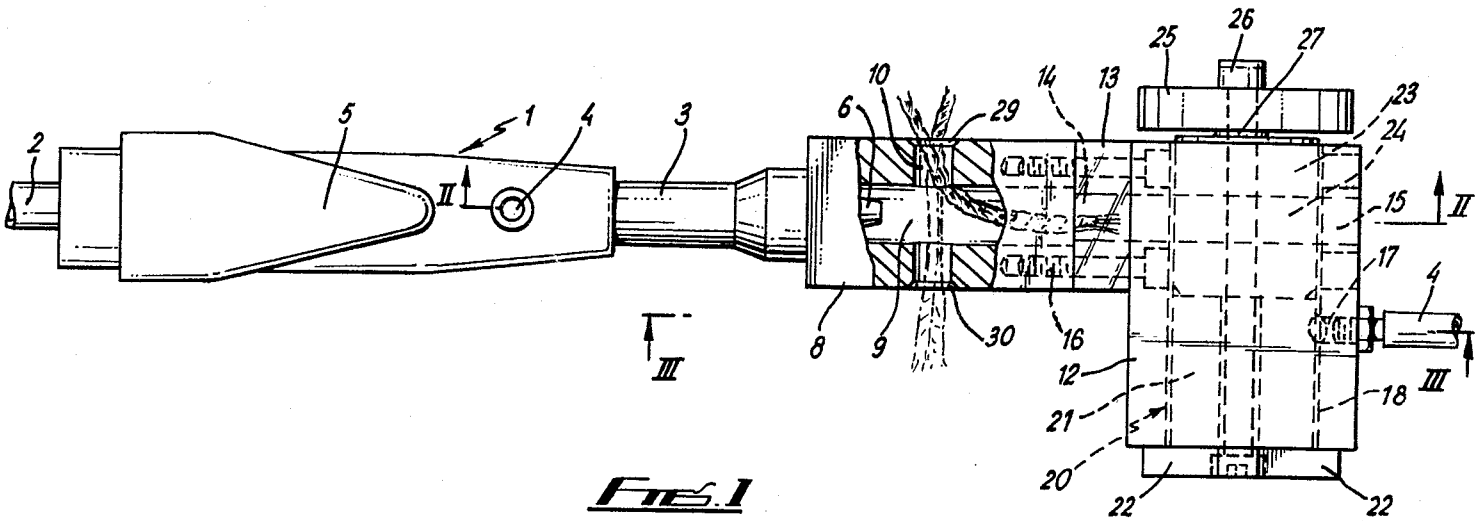
FIG. 1 is a diagrammatic partly sectioned plan view of one form of a yarn joining apparatus according to the invention.

The apparatus comprises a hand held trigger grip air control mechanism 1 having an inlet end connected via a pressure line 2 to a source of compressed air, an outlet end which is connected axially to an outlet nozzle 3 and is connected at one side to a flexible pressure pipe, and a spring-loaded lever 5 which when depressed opens a normally closed valve in a controlled manner to permit controlled flow of compressed air to the said outlet end.

The nozzle 3 is in the form of a short rigid metal tube which terminates in a jet 6. A length of wire 7 coiled into a double helix shape is wedged in the tube 3 immediately behind the jet 6.

The tube 3 is secured to a rectangular metal or plastic block 8 which contains a longitudinally extending through bore 9, and a transversely extending through bore 10 which intersects the bore 9 at right angles. The tube 3 projects into one end of the longitudinal bore 9 and the end face 11 of the block 8 which contains the opposite end of such bore 9 is secured to a side face of a further rectangular metal or plastics block 12 with a transparent perspex intermediate member 13 clamped between the two blocks 8, 12. The end of the bore 9 is in communication with aligned through bores 14, 15 in the perspex member 13 and the further block 12. The two blocks 8, 12 and the perspex member 13 are held together by fixing screws 16 which are inserted via access passages 17 in the block 12.

The block 12 contains a longitudinally extending cylindrical passageway 18 therethrough which is intersected at right angles, and approximately tangentially, by the through bore 15.

Figure 3:
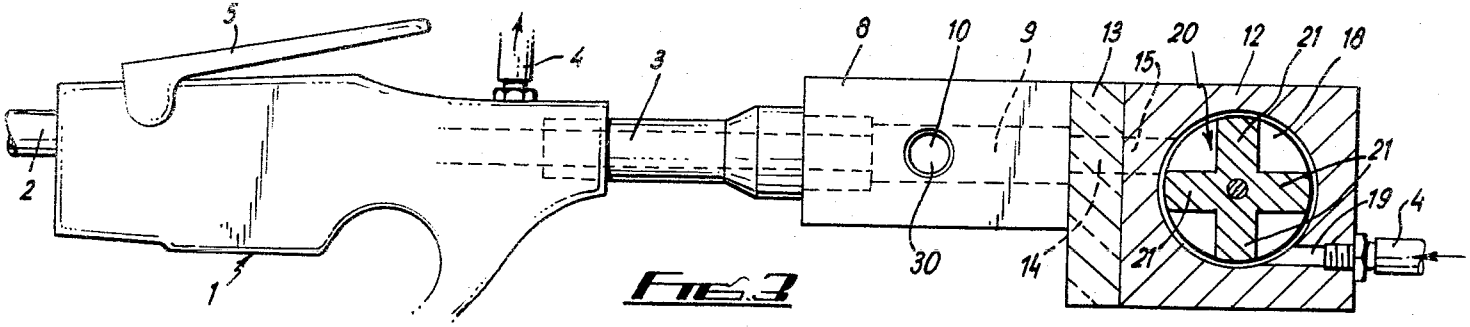
FIG. 3 is a sectional view on the line III—III of FIG. 1.

The block 12 also contains an inlet opening 19 extending from that face of the block 12 which is opposite to the block 8 and perspex member 13 into communication with the cylinder 18. The opening 19 extends parallel to the bore 15 at a position spaced therefrom longitudinally of the block 12 and at a position tantential to the cylindrical passageway 18 at the bottom thereof as seen in FIG. 3. The inlet opening 19 is connected to the pipe 4.

Within the cylindrical passageway 18 there is mounted a plastics rotor 20. The rotor 20 has at one end portion in the vicinity of the inlet 19 four equally spaced radially extending vanes 21. The vanes 21 of such portion have ends 22 which project beyond the adjacent end of the passageway 18. Such ends 22 extend radially beyond the periphery of the passageway 18 (as shown in FIG. 1). The remaining portions of the vanes 21 which lie within the passageway 18 are slightly spaced from the inner surface of the passageway, as shown in FIG. 3.

Figure 2:
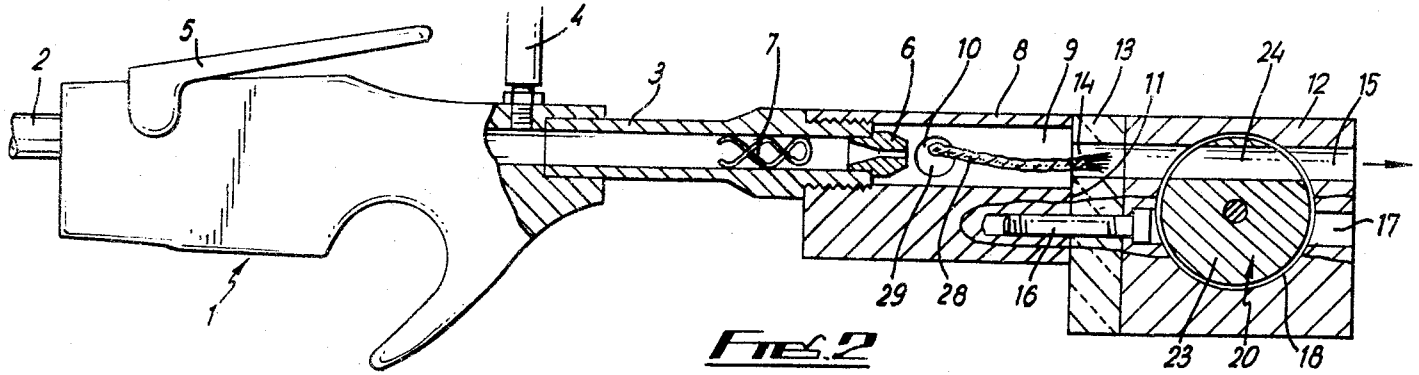
FIG. 2 is a sectional view on the line II—II of FIG. 1.

The other end portion of the rotor 20 comprises a cylindrical solid body 23 having a diameter slightly less than the diameter of the passageway 18 and which contains a tangential through bore 24 which in one rotational position of the rotor 20 is aligned with the bore 15, as shown in FIG. 2. The body 23 projects slightly beyond the adjacent end of the passageway 18 and a disc 25, of larger diameter than the passageway 18, is secured to such end by means of a bolt 26 passing axially through the entire rotor 20. The disc 25 is spaced slightly from the end of the body by means of a washer 27.

The rotor 20 is free to rotate within the passageway 18 and the vane ends 22 and the disc 25 act to retain the rotor 20 within the passageway 18 axially thereof.

In use, an operator holds the mechanism 1 with one hand and sets the rotor 20, by manually rotating same, to a position at which the bore 24 is aligned with the bore 15. Reference marks may be provided on the periphery of the disc 25 and the side of the block 12 to facilitate such setting.

The lever 5 is then operated to cause air to flow at a relatively slow rate along the tube 3 and along the bores 9, 14, 15 and 24 to the atmosphere. Air will also flow along the pipe 4 to the inlet 19 and will tend to act on the vanes 21 to cause the rotor 20 to rotate. However, at this stage rotation is prevented, for example by means of the operator placing a finger against the disc 25 to restrain same or by use of some appropriate mechanical or automatic device. Air from the inlet 19 flows along the vanes 21 to the adjacent end of the cylinder 18 and escapes from such end, between the vanes 21 to the atmosphere.

Two yarn ends 28 to be joined are positioned alongside each other and are cut to the same length and are then presented by the operator manually to one end 29 of the transverse bore 10. The flow of air along the longitudinal bore 9 produces a suction effect and the yarn ends 28 are drawn through the hole 29 into the chamber defined at the intersection of the bores 9, 10 and such yarn ends are blown along the bore into the bore 14 through the transparent perspex member 13 where such ends can be seen by the operator.

At this stage, the air flowing along the bore 9 moves helically due to the effect of the wire 7 and the fibres of the yarn ends 28 are spread apart, brought into alignment and provided with a degree of twist by the air flow to an extent dependent on the nature and properties of the yarns. The yarn ends are thereby subjected to a pre-treatment stage. If the yarns are of a very tough with nature it may be necessary to subject same to a more vigorous pre-treatment, before introducing same into the apparatus so far described, in order to open out the fibres. On the other hand, if the yarns are of a very soft bulky nature (such as knitting wool) it may be necessary to use moisture-carrying compressed air, instead of dry compressed air, in order to align the fibres. In this latter case, the compressed air may be passed through a water vessel such as to entrain water droplets before reaching the mechanism 1.

After a suitable period of pre-treatment as determined by the operator (perhaps a few seconds), the rotor 20 is released and the lever 5 is depresed further to increase the rate of air flow. The rotor 20 is caused to rotate by air pressure from the inlet 19 acting on the vanes 21. Due to the spacing between the disc 25 and the end of the body 23, an air bearing is effectively formed against such disc 25 which facilitates free rotation of the rotor 20 and acts to prevent stalling of same.

The rotor 20 rotates rapidly and as it does so the bore 15 is rapidly opened and closed as the bore 24 moves into and out of alignment with same. When the bore 15 is closed, the air flowing through the tube 3 can no longer escape along the bores 9, 14, 15 and 24 and instead the helical air flow must reverse to the said intersection of the bores 9, 10. During this stage, the end 29 of the bore 10 through which the yarn ends 28 are inserted is closed by application of the operator's finger over same and the reversed helical air flow must escape from the other end 30 of the bore 10. The yarn ends 28 are therefore drawn back out of the bore 9 and are drawn instead along the bore 10 towards the end 30 of same.

Accordingly, as the rotor 20 rotates, the yarn ends 28 reciprocate rapidly between the bore 9 and the bore 10. After a predetermined period of such reciprocation as determined by the operator (say several seconds) the air pressure is cut off and the yarn ends 28 are removed from the apparatus.

Such yarn ends 28 are then securely joined together or spliced without formation of a bulky knot or node. During this joining procedure, as with the pre-treatment stage, moisture-carrying compressed air may be used as an alternative to dry air depending on the nature and properties of the yarns.

With the embodiment described above a wide range of different kinds of yarns can be securely joined without formation of bulky knots or nodes in a particularly simple and convenient manner.

It is of course to be understood that the invention is not intended to be restricted to the details of the above embodiment which are described by way of example only. Thus, for example, instead of the transverse through bore 10 in the block 8, there may be provided a first bore which extends from a side face of the block 8 to meet the longitudinal bore 9 and through which the yarn ends 28 are introduced, and a second bore for exhaust of air during air reversal which second bore extends from the bottom face of the block 8 to the point of intersection of the first bore and the longitudinal bore 9, such that said first and second bores extend at right angles to each other. Alternatively any other suitable arrangement of yarn inlet and reversed-air outlet bores may be used.

What is claimed is:

1. A method of joining yarns comprising the steps of positioning portions of the yarns alongside each other, introducing said portions into apparatus having an inlet for said portions, and exposing said yarn portions within said apparatus to a fluid flow to effect joining of said yarn portions wherein said apparatus has two passages in communication with and extending away from said inlet and the fluid flow is directed alternately along one then the other of said passages in a direction away from said inlet such as to cause said yarn portions to be drawn alternately along one then the other of said passages.

2. A method according to claim 1, wherein said yarns are subjected to a pre-treatment stage, before said joining operation, to effect opening out and longitudinal alignment of filaments or fibres of said yarns.

3. A method according to claim 2, wherein said pre-treatment stage involves subjecting said yarn portions to a sustained fluid flow.

4. A method according to claim 3, wherein said sustained fluid flow takes place in one said passage of said apparatus.

5. A method according to claim 1, wherein said fluid flow along at least one of said passages is a helical fluid flow.

6. A method according to claim 1, wherein said fluid pre-treatment stage comprises compressed air.

7. A method according to claim 6, wherein said compressed air contains entrained liquid.

8. Yarn joining apparatus comprising a chamber with a yarn inlet thereto through which yarn portions arranged alongside each other can be introduced into the chamber, and a pressure fluid inlet to said chamber, wherein first and second passages are in communication with and extend away from said chamber, such that pressure fluid from said inlet can flow into one or the other of said passages, and diversion means is provided which is operable to effect diversion of said pressure fluid flow alternately to one then the other of said passages.

9. Apparatus according to claim 8, wherein it is in the form of a portable device having a hand held mechanism for use in the manual control of admission of pressure fluid to the said inlet, a readily accessible opening in a casing of the device, which opening constitutes the said yarn inlet, and a valve mechanism constituting said diversion means.

10. Apparatus according to claim 8, wherein the arrangement of the yarn inlet, the fluid inlet and the first passage are such that fluid tends to flow from the fluid inlet across said chamber into and along the first passage whilst producing a suction effect at said yarn inlet unless diverted to said second passage by said diversion means.

11. Apparatus according to claim 10, wherein said diversion means comprises a rotary valve having a valve member which is rotatable rapidly between alternate positions at which the first passage is respectively open and closed.

12. Apparatus according to claim 11, wherein the rotary valve member is arranged to be rotatably driven by pressure fluid taken from said fluid inlet.

13. Apparatus according to claim 8, wherein said second passage extends at right angles to said first passage.

14. Apparatus according to claim 13, wherein the said second passage is aligned with said yarn inlet.

15. Apparatus according to claim 8, wherein said pressure fluid inlet incorporates a helical structure arranged to impart helical motion to the fluid flow.

* * * * *